US007318890B1

(12) United States Patent
Malone

(10) Patent No.: US 7,318,890 B1
(45) Date of Patent: Jan. 15, 2008

(54) PITCH FRACTIONATION AND HIGH SOFTENING POINT PITCH

(75) Inventor: Donald P. Malone, Grayson, KY (US)

(73) Assignee: DTX Technologies LLC, Lexington, KY (US)

( * ) Notice: Subject to any disclaimer, the term of this patent is extended or adjusted under 35 U.S.C. 154(b) by 273 days.

(21) Appl. No.: 10/962,022

(22) Filed: Oct. 8, 2004

Related U.S. Application Data

(60) Provisional application No. 60/516,895, filed on Nov. 3, 2003.

(51) Int. Cl.
*C10C 3/00* (2006.01)
*C10C 3/10* (2006.01)

(52) U.S. Cl. ..... 208/41; 208/22; 208/40; 208/44; 208/49; 208/50; 208/67; 208/72; 208/85; 208/131

(58) Field of Classification Search ..... 208/22, 208/40, 41, 44, 49, 50, 67, 72, 85, 131
See application file for complete search history.

(56) References Cited

U.S. PATENT DOCUMENTS 1,527,847 A 2/1925 Duckham et al.
1,672,459 A 6/1928 Jansen
2,005,077 A * 6/1935 Dickson ..... 208/22
2,276,307 A 3/1942 Houdry
2,768,119 A 10/1956 Nash
3,928,170 A 12/1975 Takahashi et al.
4,012,457 A 3/1977 Bredeson et al.
4,026,788 A 5/1977 McHenry
4,671,864 A 6/1987 Sawran et al.
5,238,672 A 8/1993 Sumner et al.
5,429,739 A 7/1995 Hanks et al.
5,614,164 A 3/1997 Sumner et al.
5,619,806 A 4/1997 Warren
6,110,239 A 8/2000 Malone et al.

* cited by examiner

*Primary Examiner*—Glenn Caldarola
*Assistant Examiner*—Prem C. Singh
(74) *Attorney, Agent, or Firm*—Richard D. Stone

(57) ABSTRACT

A process for fractionating crude pitch by direct contact heating with molten metal is disclosed. The crude pitch, which may contain water, contaminants and/or distillables is heated by direct contact heat exchange with molten metal, preferably maintained as a metal continuous bath, operating at a temperature of 100 to 600° C. The molten metal heating zone is maintained at a temperature and pressure sufficient to vaporize a desired amount of contaminants or volatile material from crude pitch to produce pitch product having a desired softening point. New pitch materials, having a softening point above those achievable by conventional techniques, are also produced.

17 Claims, 2 Drawing Sheets

PITCH FRACTIONATION AND HIGH SOFTENING POINT PITCH

CROSS REFERENCE TO RELATED APPLICATIONS

This application claims the benefit, and is an edited-copy, of my prior provisional application No. 60/516,895, filed Nov. 3, 2003, which is incorporated by reference.

FIELD OF THE INVENTION

The invention relates to pitch fractionation, e.g., increasing the softening point of a crude pitch feed by removing distillable components and high softening point pitch products.

BACKGROUND OF THE INVENTION

Pitch production, making a high softening point material by thermal polymerization of normally liquid streams, is an ancient process. Use of pitch, for sealing baskets of reeds floating in the river, or for sealing Noah's ark, is reported in the *Bible*. "Make thee an ark . . . pitch it within and without with pitch." Genesis 8:14.

With the rise of great sailing ships, made of wood, use of pitch increased. Pitch was made from sap, from charcoal and from the roots of pine trees. Pine tar was used so extensively on ships that sailors were often called "tars", in reference to the constant contamination of their feet with tar used on decks and line. From 1720 to 1870, North Carolina was the world's leading producer of naval stores, turpentine, pitch and tar, all made from the state's abundant pine trees.

Wood tar has enjoyed a reputation as a sticky substance for over 100 years. North Carolina has a semi-official nickname of "The Tar Heel State" and the term is now one of admiration, rather than disrespect. The State Library of North Carolina reports the nickname relates to a civil war battle in which tenacious North Carolina fought on after troops from other rebel states left the field. The North Carolina troops responded to requests, from the rebel troops, asking if there was any tar left in the state, answering that Jeff Davis had purchased all the tar in North Carolina "He's going to put on you-un's heels to make you stick better in the next fight." Creecy relates that General Lee, upon hearing of the incident, said: "God bless the Tar Heel boys," and from that they took the name (Adapted from *Grandfather Tales of North Carolina* by R. B. Creecy and *Histories of North Carolina Regiments*, Vol. III, by Walter Clark.

The nickname is mentioned to show that for over 100 years, wood tar has been known as one of the stickiest substances around, a property which is useful for many purposes, but greatly increases the difficulty of working with the material, as will be discussed in greater detail hereafter.

While wood tar pitch was the primary pitch product for millennia, it gradually was displaced by pitch products derived from coal and, eventually, from petroleum.

All pitch production processes are similar. All start with, or produce as an intermediate product, a relatively low molecular weight, normally liquid material. Cooking pine produces pine tar, further heating of which produces wood tar pitch. Cooking coal produces coal tar, with further heating, or at least fractionation, producing coal tar pitch.

All pitch refining processes are similar whether the starting material is derived from wood, coal or petroleum. Common to all, vaporizable components are removed from non-vaporizable or non-distillable components (the pitch portion of the product). The removal of progressively more of the distillable components from the pitch fraction increases the softening point of the remaining pitch. In wood tar pitch, if too much turpentine is left in the pitch, the pitch is too soft. In coal tar pitch, if too much creosote, or other solvent, remains in the pitch, the softening point is too low. In petroleum pitch, as distillable hydrocarbons are removed, the softening point of the product pitch increases.

While distillation is basically a simple process involving heating, difficulties abound when the feed is a viscous, sticky and potentially polymerizable material like pitch. It is relatively easy to make a pitch with a lot of distillable liquids in it. Making a pitch with a softening point above 200° F., 250° F. is now practiced commercially, though it is somewhat easier to make these materials from coal tar than petroleum. This is because the coal coking process used to make coal tar produces a superheated vapor, which is cooled and fractionated to recover the coal tar fraction, while petroleum pitch requires heating to make crude pitch and further heating to fractionate.

As pitch softening points increase, production becomes exponentially more difficult. The higher temperatures required to vaporize the high boiling diluent from the crude pitch require temperatures which are high enough that the pitch production apparatus can easily coke up unless heroic measures are taken to prevent coking. Hot surfaces, e.g., metal tubes in a fired heater, produce hot spots which induce thermal polymerization and coking. Injected air, an "in situ" combustion process, can generate heat without hot metal, but the air can degrade the product while burning some of it up Pitch producers want high softening point pitches for myriad reasons. These materials have a high coking value, an essential pitch property for making carbon containing artifacts and carbon fibers. High softening point pitch materials, and intermediate products containing them, have greater mechanical strength, both during manufacture and in the finished product, as compared to like products made from lower softening point pitch. Higher carbon contents, in pitch and in products made from pitch, usually mean higher strength and better product performance. High softening point pitch is mostly carbon, and pitch value is like that of other forms of carbon, diamonds are denser, and more valuable, than graphite.

For over half a century pitch producers have sought higher softening point products. Some refiners operate pitch fractionators under vacuum (to reduce the temperatures required to vaporize volatiles). Some use a wiped film evaporator, which relies on thin films and brute force mechanical wiping to prevent the sticky pitch from staying too long in contact with a hot metal wall. Some inject inerts, such as steam, for agitation or to create a pseudo vacuum, or some combination of these approaches. Some inject air, letting in situ combustion make some of the heat. Various combinations of all of the above approaches have been tried, as refiners tried to get around an upper limit on pitch softening point which had been set by their equipment and/or approach to pitch fractionation.

At this point, processes which use special approaches to make high softening point pitch will be reviewed, to show just how much effort pitch refiners have expended toward making high softening point pitch products.

U.S. Pat. No. 2,768,119, filed Dec. 31, 1952, assigned to Phillips Petroleum, taught making petroleum pitch. An aromatic extract was prepared by solvent extraction, then the aromatic extract thermally cracked to produce a fuel oil fraction from which a pitch fraction was recovered by vacuum distillation. The patentee reported that pitch could be made from petroleum and had many of the properties of coal tar pitch. Vacuum distillation conditions included a "pressure of about 1 mm Hg, a temperature in the range 440 to 650° F. . . . " The vacuum distillation removed sufficient volatile matter to produce a product with the desired softening point (188° F. to 240° F. was reported in the patent).

U.S. Pat. No. 3,928,170 taught injecting hot gas into heavy oil to make pitch.

U.S. Pat. No. 3,974 and U.S. Pat. No. 4,026,788, McHenry, taught pitch manufacture with inert gas sparging.

U.S. Pat. No. 3,976,729 and U.S. Pat. No. 4,017,327, Lewis, taught making pitch with agitation during heat treatment.

U.S. Pat. No. 4,039,423, assigned to Gulf Oil, taught heating, flashing and "oxy-activation" to make pitch.

U.S. Pat. No. 4,066,737, assigned to Koppers, describes an oxidative pitch process as part of a method of making carbon fibers.

U.S. Pat. No. 4,242,196 assigned, inter alia to Sumitomo Metal, taught heating a resid to 450-520° C. in a tubular heater for 0.5-15 minutes, then passing an inert gas at 400-2000° C. for direct contact heating for ½-10 hours, to make pitch.

U.S. Pat. No. 4,431,512, assigned to Exxon, taught heat soaking steam cracker tar middle distillate at 420-440° C. for 2-6 hours, then vacuum stripping. Their U.S. Pat. No. 4,427,530 disclosed a similar process using FCC bottoms as feed.

U.S. Pat. No. 4,673,486 taught treating a solvent deasphalted fraction with a carrier gas, and thermally cracking at 400-600° C. to produce a gas oil fraction and a pitch product.

U.S. Pat. No. 4,999,099 taught use of an oxidative purge gas to make pitch. An FCC heavy resid fraction was heat soaked at 385° C., then subjected to an $O_2$+$N_2$ sparge.

U.S. Pat. No. 5,540,832, assigned to Conoco Inc., taught making mesophase pitch from refinery decant oil residue by heat soaking at 386° C. for 28 hours with $N_2$ agitation.

Ashland Petroleum obtained a series of patents on high softening point pitches, primarily for manufacture of carbon fiber. U.S. Pat. No. 4,671,864 taught vacuum flashing, or use of a wiped film evaporator (WFE), to reduce residence time of pitch at high temperature and form a pitch having a softening point of about 250° C. U.S. Pat. No. 5,238,672 taught heating isotropic pitch with inert gas, at high temperature, to make mesophase pitch. U.S. Pat. No. 5,316,654 taught use of WFE to make high softening point pitch. U.S. Pat. No. 5,429,739 taught use of a thin film, reduced pressure and partial oxidation to make high softening point pitch, converting a conventional 250° F. softening point pitch to high softening pitch in a WFE. Partial oxidation sped up the process. U.S. Pat. No. 5,614,164 taught starting with a pitch with a softening point of 93-233° C., WFE processing for 115-300 seconds to produce "enriched pitch" then stripping with an inert gas for up to 18 hours to produce pitch product, with a softening point of 177-399° C.

The Eureka® Process, developed by Kureha Chemical Industry Co. Ltd and Chiyoda, has been used for over 20 years to make pitch products. The process injects steam into the pitch forming reactor to create a pseudo vacuum and keep the molten pitch as a homogeneous liquid.

Although not related to pitch production, mention will be made at this point of use of molten metal baths, to dry paper pulp, in U.S. Pat. No. 5,619,806, Drying of Fiber Webs, Warren. The patentee used an alloy composition of bismuth and zinc. Molten metal baths are also used for metal plating and for the float process to make plate glass.

All of the patents discussed or referred to above, and hereafter, are expressly incorporated by reference, in their entirety.

I reviewed these multiple routes to pitch products, especially to high softening point pitch products and found none completely satisfactory. I realized that much of the difficulty of processing pitch to fractionate it to increase its softening point was inherent in the material. The same sticky properties which made it a theoretical super glue for soldier's feet made it a bear to process using conventional technology. I did not want to burn or oxidize product to make higher softening point pitch (oxygen or air injection). I did not want to use conventional hot metal surfaces to heat viscous pitch products or precursors sufficiently to distill vaporizable components. Fired heaters, with their hot metal surfaces had a cursed "Midas touch" for such sticky tars and rapidly initiated thermal polymerization, further reducing viscosity. The viscous, sticky material would cling even longer to metal surfaces and the long residence time lead to coking, which further reduced the viscosity. This problem, of things getting even stickier because of contact with hot metal, has been around for millennia, and the usual remedy—constant stirring—helped, but only up to a point. As temperatures, and pitch softening points, increased, coking tendencies increased, so that resort was made to expensive and mechanically complicated stirring systems, wiped film evaporators. I wanted to avoid the high cost of continuous stirring, the high capital and operating cost, and limited throughput, of wiped film evaporator technology.

While I wanted a better route to high softening point pitch, I was also interested in improving existing pitch processes, whether based on wood, coal or petroleum pitch.

In reviewing the problems of pitch fractionation processes, which have been around for millennia, I discovered an entirely new way to fractionate crude pitch which completely avoided the problems associated with prior processes.

I realized that a technology used for decades to make plate glass (forming glass on a bed of molten metal), could overcome the heating barrier imposed by solid metal heating surfaces. If molten glass does not stick to molten metal, neither would molten pitch. I used a molten liquid heating medium which would heat pitch but to which pitch would not stick. Using molten metal, it was possible to heat pitch sufficiently to vaporize volatile components and avoid the sticking problem.

The molten metal bath was wonderfully efficient at heating the pitch. Molten metal was relatively free of hot or cold spots, because of its high thermal conductivity. Most important, crude pitch does not stick to molten metal, eliminating the sticking and coking problem associated with hot metal.

Molten metal also permits a flexible design approach, permitting injection of the metal into the oil or vice versa, though not necessarily with equivalent results. When pitch is injected into a molten metal bath, it is possible to increase or decrease to some extent fractionation severity by changing the depth of molten metal in the bath, the temperature of the metal, the pressure in the molten metal bath or the presence of a stripping gas to create a "pseudo vacuum", or some combination of these. For the first time, pitch producers have many more degrees of freedom to pursue the best pitch product, in a process which is wonderfully tolerant of mistakes. While mistakes may be made, they will not stick to the molten metal, so a pitch fractionator can generally continue in operation even if some coke solids are produced by mistake.

BRIEF SUMMARY OF THE INVENTION

Accordingly, the present invention provides a process for fractionating a crude pitch feed having a softening point and comprising a non-distillable pitch fraction and vaporizable diluents or contaminants to produce a liquid pitch product having a higher and desired softening point comprising heating said crude pitch by direct contact heat exchange with molten metal for a time sufficient to produce heated crude pitch; and vaporizing at least a portion of said vaporizable diluent or contaminants from said heated pitch to produce a vapor phase comprising at least a portion of said diluent or contaminants and a liquid pitch product phase comprising pitch having an increased and desired softening point and a reduced content of vaporizable diluents or contaminants, as compared to said crude pitch feed, and recovering said liquid pitch product phase as a product of the process.

In another embodiment, the present invention provides a process for fractionating a crude pitch feed containing non-distillable pitch and vaporizable diluents to produce a pitch overhead vapor product and a liquid pitch product having a desired softening point comprising heating and at least partially vaporizing said crude pitch by direct contact heat exchange with molten metal in a heating zone for a time sufficient to produce heated and at least partially vaporized crude pitch; and recovering, as separate products from said heating zone, a vapor phase product comprising vaporizable diluents vaporized from said crude pitch and a liquid pitch product phase comprising pitch having a desired softening point and a reduced content of diluents or contaminants as compared to said crude pitch feed.

In yet another embodiment, the present invention provides a pitch product having a softening point above 550° F., preferably above 400° C.

The invention will be more fully understood from the following description of the preferred embodiment taken in conjunction with the figures.

DETAILED DESCRIPTION OF PREFERRED EMBODIMENTS

Figure 1:
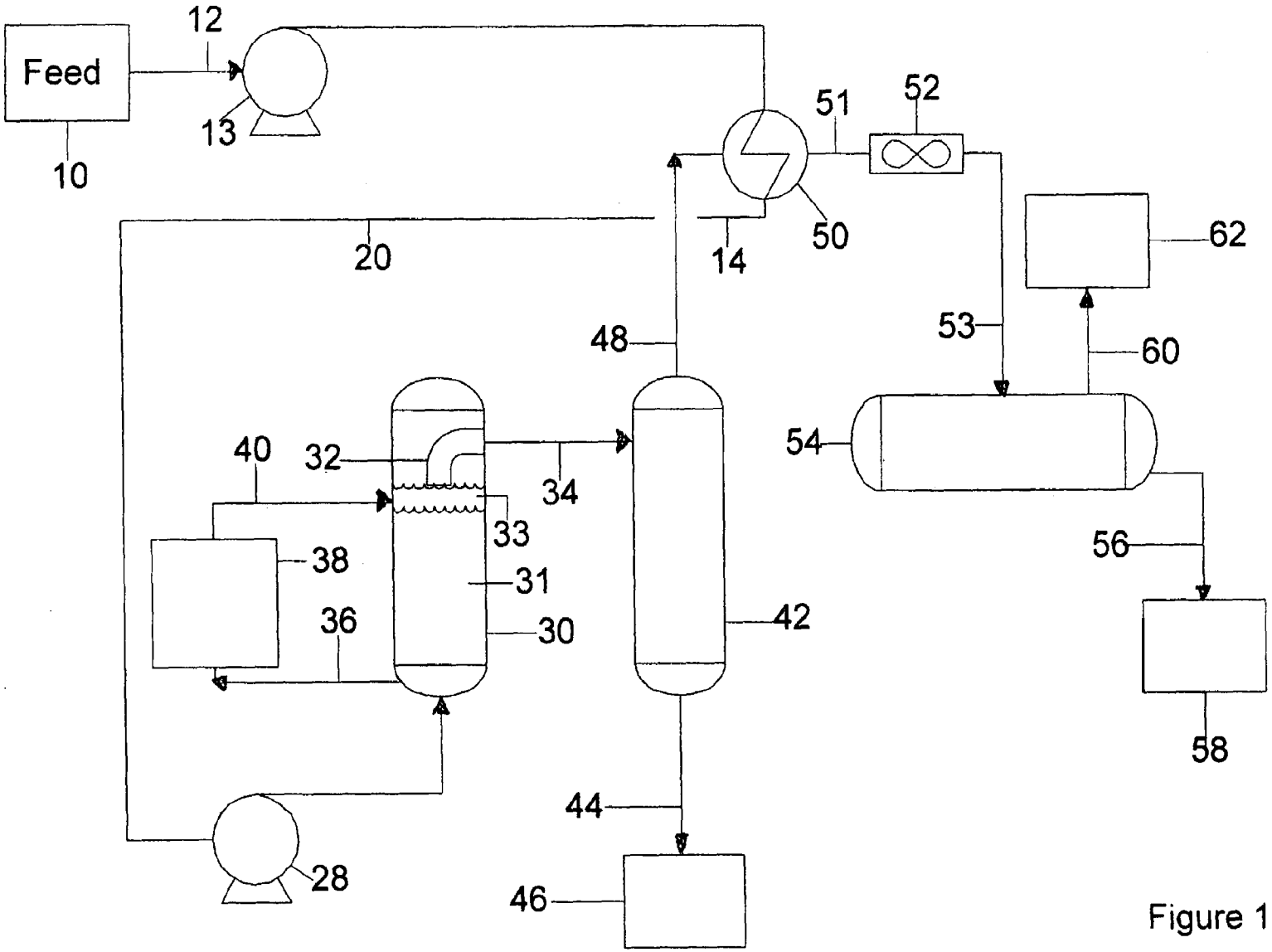
FIG. 1 is a simplified schematic drawing of a preferred embodiment wherein a low softening point pitch is heated in a single molten metal bath, with injection of feedstock into a lower portion of the molten metal bath, to produce a higher softening point pitch.

In FIG. 1, a feedstock, e.g., a crude pitch to be fractionated, flows from a feed storage system, 10, through line 12 to the feed pump 13 to heat exchanger 50 to produce a preheated pitch feed. Preheated feed is charged via lines 14 and 20 through optional pump 28 into direct thermal exchange heating zone 30. Sometimes the term DTX will be referred to as this zone or this approach, using molten metal for Direct Thermal eXchange (DTX) of crude pitch. Any heat transfer fluid that is immiscible with, and preferably much denser than, crude pitch feed may be used, but molten metal is ideal. In the embodiment shown, molten metal circulates from the bottom to the top of contactor vessel 30. DTX fluid is removed from the DTX heating zone 30 by line 36, heated in heater 38 to produce heated molten metal which is discharged via line 40 to heating zone 30. Heater 38 may use electrical resistance elements, a fired heater, superheated steam or the like as a heat source. Although a separate molten metal heater 38 is shown, it is also possible to dispense with the separate molten metal heater and use electric resistance heaters or other heating jacket means, not shown, disposed around the heating zone 30 to satisfy the heat demand of the process. Heat transfer fluid flow through heater 38 may be controlled by natural convection, as shown, or a pump, not shown, may be used. The total liquid level in the contactor, 33, is maintained by a vertical outlet pipe, 32, through which all gas, vapor and liquid leave the vessel and flow through line 34, to the separator vessel, 42. The inventory of heat transfer fluid sets its level in the contactor or heater 30. When the level of the heat transfer fluid 31 is relatively high as shown in FIG. 1, the crude pitch feed is the predominately dispersed phase and the molten metal heat transfer fluid is the predominately continuous phase.

There are preferably three generally continuous phases in crude pitch heater 30. As previously stated, the molten metal phase 31 is continuous and fills the lower portion of vessel 30. Preheated crude pitch feed is charged to or near the bottom of the molten metal phase. A distributor or weir, not shown, may be used if desired. The entering crude pitch is rapidly heated by direct contact with molten metal. With heating, some of the vaporizable components of the crude pitch are vaporized. At this point, there are three phases in the molten metal bath 31—the continuous metal phase, a generally dispersed liquid phase of injected crude pitch and a generally dispersed gas phase of bubbles formed by heating and vaporization of volatile components in the crude pitch. The liquid pitch and vapor phases pass up through the continuous molten metal phase, with additional heating and vaporization of liquid pitch occurring as the liquid pitch rises in the molten metal bath. The liquid pitch and vapor emerge from the molten metal continuous phase 31 and enter another continuous liquid phase 33, comprising heated pitch through which bubbles of pitch vapor ascend. A modest inventory of pitch liquid is maintained above the molten metal bath, with the lower limit on pitch liquid bed depth set by the top layer of the molten metal bath and the upper limit on pitch liquid set by vapor/liquid withdrawal means 32 disposed a distance above the molten metal bath. Pitch liquid will accumulate in region 33 until the pitch liquid level is sufficiently high so that the net input of pitch liquid is removed or entrained with gas flow through outlet 32. Heated pitch liquid and vapor components are then transferred via line 34 to vessel 42 wherein pitch vapor is allowed to separate from pitch liquid. Pitch liquid with the desired softening point is withdrawn from vessel 42 via line 44 and collected in product tank 46. The vapors produced by pitch fractionation are removed via line 48 and used as a heat exchange fluid to preheat incoming crude pitch in heat exchanger 50. The cooled pitch vapors are withdrawn from exchanger 50 and charged via line 51 to fin fan cooler 52 or other heat recovery or cooling means, not shown, to produce a cooled and condensed pitch overhead vapor stream which is charged via line 53 to overhead receiver 54. A pitch overhead receiver vapor phase is removed via line 60 and charged to product storage means 62, or burned as fuel by means not shown. The pitch overhead receiver liquid is removed via line 56 and collected in product storage tank 58.

Figure 2:
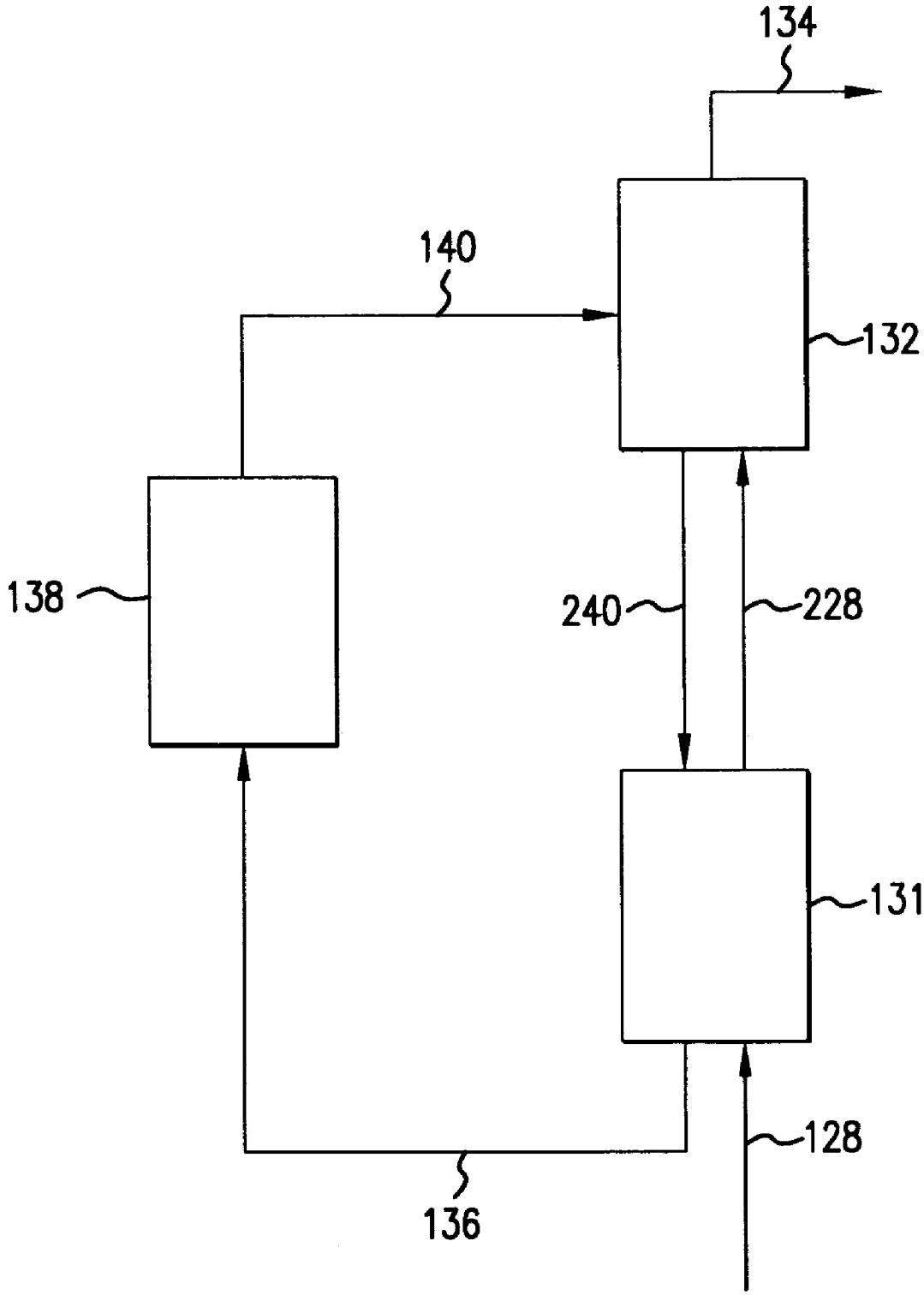
FIG. 2 is a block flow diagram of a multi-zone molten metal pitch process, analogous to a multi-tray fractionator.

FIG. 2 is a simplified, block diagram of the process flow involved when two stages of molten metal heating of a crude pitch occur. The process flow is somewhat similar to that which occurs in a fractionator with two trays, at least in terms of vapor and liquid flow, but very different in terms of temperature. Molten metal flows down the "distillation column", while crude pitch feed in line 128 is added to the bottom of the column. Liquid bubbles up via line 228 from the first "distillation stage" 131 to enter the molten metal bath in the second "distillation stage" 132 for further heating and vaporization. The vapor phase from the first distillation stage may be removed from the process or passed up with the partially refined crude pitch into the second stage. Temperatures increase up the column, with the temperature highest in the top or second stage and lowest in the first stage. This temperature profile is achieved because the metal starts cooling as soon as it enters the "tower" via line 140 and starts work heating and vaporizing the crude pitch. The metal enters the top of the "fractionator" at its peak temperature and is cooled by heating and vaporizing the pitch liquid and/or vapor, removed via line 134, in the top distillation stage. This somewhat cooled molten metal then flows down via line 240 to the lower distillation stage, where further cooling of molten metal occurs because it is heating the incoming crude pitch feed. The molten metal is withdrawn via line 136 from or below the lower stage and pumped or, preferably, sent through a thermosiphon reboiler 138, as in FIG. 1

Molten Metal Bath

Any metal can be used as part or all of the molten metal bath, so long as it is in a liquid phase at the desired operating temperature. Metals which can be used include lead, tin, antimony, mercury, cadmium, sodium, potassium, bismuth, indium, zinc, gallium. Not all metals will give equal results and some present significant safety concerns, e.g., lead or mercury, but they can be included as part of the molten metal bath, if desired.

Pitch Feedstocks

Any pitch feed containing volatile components can be heated using the process of the present invention. When wood tar pitch, or wood tar containing pitch components, is the feed, the vaporizable components may include turpentine. When coal tar pitch is the feed, the vaporizable components may include creosote. When petroleum pitch is the feed, the vaporizable components may include normally liquid hydrocarbons, typically boiling in the gas oil or vacuum gas oil range. A pitch fraction may also contain water or other diluents, either as contaminants or as a result of some mishap in blending or manufacture.

The invention contemplates the use of a range of molten metals for the high-intensity drying and/or heating process. These include low-melting point metal alloys. When simple drying or only a modest amount of thermal processing is desired, the candidate molten fluids may have melting points typically ranging from 60-230° C. or higher.

It is essential that the heating fluid be immiscible with the crude pitch feed and substantially denser. The interfacial surface tension between the molten metal heat transfer media, or other molten fluid used to heat the feed, and the liquid crude pitch feed should be sufficiently high to prevent sticking of the pitch to molten fluid. The thermal conductivity of the molten fluid should be sufficiently high to ensure that the molten heating fluid remains in a liquid state during use, so that it does not solidify to form a solid film or freeze cone at the point of feed injection or contact.

When the thermal conductivity of the fluid is sufficiently high, the fluid conducts heat from the body of the molten bath to the interface contact region between drops or streams of feed and molten heating medium, or drops or streams of molten heating medium when the feed is the continuous phase. The use of molten metal alloys is preferred due to their high interfacial surface tension with both high softening point pitch product and trash that may be found in the feed. Metals are also preferred over other immiscible fluids due to their high thermal conductivity. An additional benefit is the high density of molten metal relative to feed, which promotes rapid transit of one fluid through the other and plenty of motive force should baffles or column packing be used.

Table 1 summarizes some estimated properties for several recommended molten metal eutectic alloy materials, when only moderate severity heating is required. This alloy information is taken from information reported in U.S. Pat. No. 5,619,806, which is incorporated by reference.

TABLE 1

Properties of Candidate Molten Materials

| | Melting Temp ° C. | Therm. Cond. (Btu/ft$^2$/h/° F.) | Spec. Heat (Btu/lb/° F.) | Surface Tension (dyne/cm) |
|---|---|---|---|---|
| In/Sn(52/48) | 118 | 19.6 | 0.060 | 580 |
| Bi/Pb(55/45) | 124 | 7.7 | 0.035 | 391 |
| Bi/Sn(58/42) | 138 | 11.6 | 0.046 | 447 |
| Sn/Pb(63/37) | 183 | 14.5 | 0.051 | 528 |
| Sn/Zn(92/8) | 199 | 20.0 | 0.061 | 594 |
| "Tin Foil" Sn/Cu(99/1) | 227 | 19.0 | 0.061 | 587 |

The metallic material of the bath may consist of an alloy selected from the group that includes:

i) Ga/In ii) Bi/In iii) In/Sn iv) Bi/Pb v) Bi/Sn vi) Sn/Pb vii) Sn/Zn viii) Sn/Cu.

A spectrum of molten metal temperatures can be used, from high to low. Based on the float bath process for making plate glass, tin has ideal properties when a relatively high temperature bath is desired. Tin has a melting point of 232° C. and a boiling point of 2623° C. This means that a range of temperatures can be achieved in the molten metal bath, ranging from temperatures near the boiling point of water (when a low melting alloy like Wood's metal is used) to temperatures above 500° C. For ease of startup, i.e., a relatively low melting point, a tin-bismuth alloy is preferred.

Softening Point v. % Fractionation

In general, the process of the present invention does the same thing as prior art pitch fractionation processes, i.e., feedstocks, % recovered as an overhead fraction, and response of the residue or pitch fraction in terms of softening point. What is profoundly different is the ease with which a significant amount of the volatile material can be removed from a pitch feed. The process of the present invention also allows pitch refiners to operate in regions which were not possible using prior art techniques.

When starting with a 240° F. softening point pitch, it is possible to remove from 0 to 50% or more of the feed weight and increase the softening point of the pitch accordingly. Based on published reports of WFE treatment to remove say 50% of the volatiles from a 240° F. softening point pitch, use of DTX heating to fractionate the pitch to the same degree will produce a pitch product with a softening point of 500 to 510° F.

Experiments

Experiments were conducted to test the concept of use of a molten metal bath to heat a hydrocarbon liquid feed. Temperatures used were relatively low, sufficient to distill some vaporizable hydrocarbons, but generally lower than the temperatures that would be used in a commercial plant. No pitch product was produced in this example.

The thermal reactor was a length of 4" schedule 40 stainless steel pipe. The metal alloy used was a tin-bismuth eutectic that is 42% tin and 58% Bismuth. The depth of molten metal was about 20", with about 12" of freeboard or vapor space above the molten metal. The stainless steel pipe was heated by a cylindrical heater, an electric jacket with a thermostat. The initial series of tests on feed was conducted at about 600° F. molten metal bed temperature. The feed was fed into the bottom of the molten metal bath via a ¼" nipple to which a length of ⅛" SS tubing was affixed. The tubing did not extend into the molten metal bath. The process ran under vacuum, estimated at about 0.5-1 psia, but the pressure gage used was not very accurate at these low pressures.

Based on the work done to date, the preferred metal composition is the tin-bismuth eutectic that is 42% tin and 58% Bismuth.

When making a high softening pitch product, with softening point of around 500° F., the temperature and pressure will be around 650° F. and pressure will be 10 to 25 mm Hg. These fractionation conditions are based on working with a pitch feed with a softening point of around 200 to 250° F., which is a readily available commercial pitch feed, available both in the form of coal tar pitch and petroleum pitch. If the pitch feed has a significant amount of "light ends", or vaporizable contaminants, then it may be preferable to subject the pitch feed to a preliminary treatment, in either a conventional fractionator or a DTX heater, operating at lower temperature and less vacuum, atmospheric pressure, or even a positive pressure, to strip out the light ends, so that the vacuum system will not be overwhelmed with volatiles and the plant will run smoothly.

It is possible to operate the DTX heater at any temperature and pressure used in any of the prior art patents to produce pitch. When the temperature and pressure in the DTX heater are the same as those experienced in a prior art process, e.g., one using a WFE to remove volatile components from pitch, roughly the same products will be produced. Although the DTX heater operates with ease in the operating conditions of the prior art, it is not constrained by these conditions, particularly as to temperature. The DTX heater can operate at higher temperatures than was possible in the prior art, leading to new pitch products, with unusually high softening points.

Although the DTX heater allows facilitates operation in hitherto uncharted temperatures, it also works well at conventional, lower temperatures. It is possible to use the DTX heater to make minor adjustments to product properties of a refined pitch. A refiner with a large investment in a conventional pitch plant may use DTX heating as a pre- or post-treatment step. An example of a pretreatment step is de-bottlenecking an existing facility by removing some light ends from the crude pitch feed, to increase capacity of a conventional plant. A post-treatment step would to allow a pitch with a softening point of 225° F. to be made using the conventional plant, with a modest portion of the conventional product given a mild DTX heating treatment to produce a pitch with a softening point of 275° F.

In addition to pre- or post-treatments, multiple DTX crude pitch treatments may be practiced, as when two, or more, DTX heaters successively contact a crude pitch stream. A first DTX heater might dehydrate a crude pitch stream and/or remove light ends, materials boiling in the light naphtha range, e.g., pentane and lighter materials. A second DTX heater could remove heavy naphtha and/or gas oil boiling range materials at atmospheric pressure, or under a slight vacuum, producing an intermediate pitch product with a softening point of 150 to 300° F. It should be noted that this 300° F. softening point is well above that achievable when conventional pitch fractionation is processed, but when a DTX heater is used, it is possible to run this second stage at sufficiently high temperature to drive off the amount of vaporizable hydrocarbons desired and produce a relatively high softening point pitch product, though some vacuum or steam injection will usually be required as temperatures increase to produce the higher softening point product. Any third, or subsequent, DTX heating stages will usually be run at a vacuum, so that a sufficient amount of volatile material can be removed without resorting to unduly high temperatures, though it should be recognized that the DTX heater and coking thereof will not be limiting factors, rather product degradation will be the limiting factor.

When multiple stages of DTX heating are practiced, each stage is roughly equivalent to a single perfect fractionation stage. There will be considerable overlap of boiling range of overhead products, which is to be expected when a "pot still" is used as a fractionator. This will not be a problem when the pitch product is the most valued and/or the most important product, in that pitch product properties are not greatly sensitive to the molecular weight range of diluent present in pitch.

If pitch properties are the only important factor, and the overhead's value is about the same whether it is a single pure stream or 2, 3 or more separate product streams, then it will be feasible to run using only a single, or just two, stages of DTX heating to achieve the desired pitch product. When overhead properties are important, e.g., the gas oil boiling range material is valuable, perhaps after hydrotreating, as jet fuel or as charge to a conventional FCC unit, but the other overhead materials have only fuel value, then use of multiple DTX stages to optimize overhead product properties and profits becomes justified, as refiners use multiple distillation trays to obtain a spectrum of products from a crude petroleum.

Pitch refiners may wish to operate under a hard vacuum, mild vacuum, atmospheric or super-atmospheric pressure, to minimize vapor volumes and facilitate processing of streams with large amounts of water and/or volatile components. Higher pressures permit a more compact facility to be built.

It is important to use a molten metal, usually a metal alloy, with a "heat range" within that required for the desired process objectives. When simple dehydration is all that is required, and this will usually be a first or preliminary treatment rather than the entire process, molten metal which is molten in the 80° C.+ temperature range is suitable. When stripping of naphtha and or gas oil or vacuum gas oil boiling range materials from the pitch feed is desired, the metal must remain molten at temperatures above 100° C. to say 600° C. When very high softening point pitch is the desired product, a heat range of 200° C. to 700° C. or higher may be desirable.

The upper limit on temperature/choice of the metal alloy is determined by volatility and process constraints. The preferred molten metals will have a low vapor pressure at the temperatures used, so that loss of molten metal due to "dusting" or for any other reason is less than 1% a day. The metals chosen should not be corrosive under process conditions and preferably are non-toxic, for safety.

For clarity, what is old and what is new about the DTX pitch fractionation process and products of the process, will be reviewed and summarized.

There is nothing novel, per se, about a molten metal bath—such baths are well known and widely used in metal casting, manufacture of plate glass, metal coating operations and the like. There is nothing novel about the feedstocks used, any conventional pitch feeds, whether derived from wood, coal, petroleum or some hereafter developed source, can be used. The overhead products of each DTX heating stage are, in general not novel, they will have about the same composition as overhead products obtained in the past using conventional heating methods, e.g., a WFE, to produce a given softening point pitch product. The pitch products of DTX pitch fractionation will be about the same as pitch products of conventional technology. The product properties of a petroleum pitch having an initial softening point of 240° F. processed in a WFE under vacuum to produce a pitch with a softening point of 500° F. will be similar to a like DTX pitch fractionation product having the same product softening point when processed under the same vacuum. Thus it can be seen that many parts of the process, from pitch feeds to pitch products, to the temperature and pressure used to vaporize diluent from crude pitch, can be conventional.

Although much is old, several aspects of the DTX process are new. The most significant aspect, at least in the near term, is the greatly reduced cost, simplification, and increased reliability of pitch manufacturing due to DTX heating for pitch fractionation. An aspect with great potential, is the use of DTX pitch fractionation to make very high softening point pitch products never made before. The DTX pitch fractionation process allows production of pitch products having a higher softening point than obtainable by conventional technology. There is little demand for these materials now, but this lack of demand is believed primarily due to the fact that no one could make these materials, or in the case of WFE produced pitches, that they were only available in small amounts, at high cost.

The new manufacturing process allows production of higher softening point pitch products, with over an order of magnitude reduction in capital cost for the plant and a like reduction in operating costs, as compared to a process using WFE. WFE was the best approach to making, e.g., 500° F. softening point pitch, but such plants are expensive to build, costly to maintain and produce relatively small amounts of pitch. As discussed in the review of the prior art, attempts were made to improve the productivity of WFE by addition of oxygen to increase throughput, but such approaches only modestly increase production and oxygen can degrade the product and create safety concerns. One of the advantages of the molten metal approach, especially as compared to oxygen addition, is that the molten metal does not do anything other than heat the pitch, there is no chemical reaction with any of the pitch feed or products.

The DTX approach is not restricted to a thin film of product. There is no need for mechanical wipers, the molten metal bath is inherently non-sticky and pitch passes through it, or vice versa, readily. The DTX approach is inherently reliable, there need be no moving parts in the plant, except for external product addition or withdrawal. Refiners are used to working with hot fluids and much "off the shelf" equipment is available to deal with working fluids at the temperatures and pressures contemplated for DTX fractionation of pitch. It is easy, by design, to have a DTX pitch fractionator as shown in FIG. 1 with no mechanical moving parts in the plant. Heat addition can be via the molten metal bath shown which uses the principal of a thermosiphon reboiler to circulate molten metal, or an external heating jacket, can be used around the DTX heating vessel.

The heart of a DTX pitch fractionator is a molten metal heating bath, which can be built without any mechanical moving parts. The DTX process uses thermodynamics, molten metal and fluid dynamics as an elegant solution to the problem of heating and vaporizing a crude pitch to produce a higher softening point pitch. Such a process can run for years without shutdown.

I claim:

1. A process for fractionating a crude pitch feed having a softening point and comprising a non-distillable pitch fraction and vaporizable diluents or contaminants to produce a liquid pitch product having a softening point of 200 to 600° F. comprising:

a. heating said crude pitch by direct contact heat exchange with an immiscible molten fluid for a time sufficient to produce heated crude pitch, b. vaporizing at least a portion of said vaporizable diluent or contaminants from said heated pitch to produce a vapor phase comprising at least a portion of said diluent or contaminants and a liquid pitch product phase comprising pitch having an increased and desired softening point and a reduced content of vaporizable diluents or contaminants, as compared to said crude pitch feed, and c. recovering said liquid pitch product phase as a product of the process.

2. The process of claim 1 wherein said crude pitch feed is selected from the group of wood tar pitch, coal tar pitch and petroleum pitch.

3. The process of claim 1 wherein said pitch feed has a softening point within the range of 100 to 250° F. and said liquid pitch product has a softening point at least 100° F. higher than that of said pitch feed.

4. The process of claim 1 wherein said heating and vaporizing occur in a single stage.

5. The process of claim 1 wherein said heating and vaporizing occur multiple times in multiple stages, with the pitch product from an initial stage being a pitch feed to subsequent stages and wherein a vapor phase is removed after each stage of heating.

6. The process of claim 1 wherein said heating occurs in a molten metal continuous bath into which, or up through which, said crude pitch is charged.

7. The process of claim 1 wherein said heating occurs in a liquid pitch continuous bath into which, or down through which molten metal in injected or dispersed.

8. The process of claim 1 wherein said heating and vaporizing occur simultaneously.

9. The process of claim 1 wherein said heating of said crude pitch by direct contact heat exchange occurs at a pressure sufficient to maintain a liquid phase to produce heated crude pitch and said vaporizing step occurs when heated crude pitch is discharged into a flash drum operating at a lower pressure and is flashed therein to produce a vapor phase and a pitch product having the desired softening point.

10. The process of claim 1 operating with a molten fluid temperature within the range of 100 to 600° C. and a pressure from 0.01 to 1 atmospheres.

11. A process for fractionating a crude pitch feed containing non-distillable pitch and vaporizable diluents to produce a pitch overhead vapor product and a liquid pitch product having a softening point of 200 to 600° F. comprising:

a. heating and at least partially vaporizing said crude pitch by direct contact heat exchange with molten metal in a heating zone for a time sufficient to produce heated and at least partially vaporized crude pitch, and b. recovering, as separate products from said heating zone, a vapor phase product comprising vaporizable diluents vaporized from said crude pitch and a liquid pitch product phase comprising pitch having a desired softening point and a reduced content of diluents or contaminants as compared to said crude pitch feed.

12. The process of claim 11 wherein said molten metal is maintained as a continuous phase in said heating zone.

13. The process of claim 11 said crude pitch feed is maintained as a continuous phase within said heating zone.

14. The process of claim 11 wherein said crude pitch is selected from the group of wood tar pitch, coal tar pitch, petroleum pitch and mixtures thereof.

15. The process of claim 11 wherein said crude pitch has a softening point of 180 to 250° F. and said product pitch has a softening point of 200 to 600° F.

16. The process of claim 1 wherein said direct contact heat exchange occurs at 10 to 25 mm Hg.

17. The process of claim 11 wherein said direct contact heat exchange occurs at 10 to 25 mm Hg.

* * * * *